United States Patent [19]

Muzak et al.

[11] 4,423,857

[45] Jan. 3, 1984

[54] SPACER FOR BATCH COIL ANNEALING

[75] Inventors: Nicholas Muzak, Hamilton; Montague J. Robinson, Campbellville, both of Canada

[73] Assignee: Stelco Inc., Hamilton, Canada

[21] Appl. No.: 394,903

[22] Filed: Jul. 6, 1982

[51] Int. Cl.[3] ..... F27D 5/00

[52] U.S. Cl. ..... 266/262; 432/260; 266/287; 266/249

[58] Field of Search ..... 266/287, 249, 262; 432/260; 29/150

[56] References Cited

U.S. PATENT DOCUMENTS

| | | | |
|---|---|---|---|
| 3,149,827 | 9/1964 | Whitten | 432/260 |
| 3,618,921 | 11/1971 | Corbett, Jr. | 266/262 |
| 3,879,167 | 4/1975 | De Luca et al. | 432/249 |

*Primary Examiner*—L. Dewayne Rutledge
*Assistant Examiner*—Christopher W. Brody
*Attorney, Agent, or Firm*—Sim & McBurney

[57] ABSTRACT

This invention provides a spacer for vertically separating coils in an annealing furnace. The spacer includes a lower segmental plate and an upper segmental plate, and ribs between the segmental plates and affixed thereto. A porous medium is disposed between the segmental plates, so that the porous medium can be heated by hot gas passing through it, and can then radiate heat to the inside surfaces of the segmental plates.

6 Claims, 3 Drawing Figures

SPACER FOR BATCH COIL ANNEALING

This invention relates generally to the art of annealing metal within an annealing furnace, and in particular to annealing coils of sheet metal. More particularly, this invention has to do with a spacer construction adapted to be inserted between and to vertically separate adjacent sheet metal coils within an annealing furnace.

BACKGROUND OF THIS INVENTION

In conventional batch annealing, coils of steel are placed on stools with the eye vertical, in stacks of four or five high, depending upon coil width. Conventionally, the stacked coils are separated from one another by a finned spacer or spacer plate which permits some of the continuously circulating protective gas to pass between the coils. An inner cover is then placed over the coils and a protective atmosphere such as nitrogen is introduced inside the inner cover. This protective atmosphere is caused to circulate through and around the coils by any conventional fan means.

A furnace is placed over one or a plurality of these inner covers and is fired. Heat from the combustion gases is transferred to the inner cover by radiation and convection. From the inner cover the heat is transferred to the coils primarily by radiation, but also by virtue of convection within the inner cover. Within each coil, heat is transferred by conduction along the wraps, and also by inter-wrap re-radiation. Because of the low rate of heat transfer, firing times are long and thermal efficiency is low.

It has been found that the last part of the coil to reach the desired annealing temperature is located at its mid-thickness and mid-way between the eye and the outer wrap. It has also been shown that if the coil is placed in the furnace with its eye in the horizontal position, the rate at which the middle of the coil heats to the desired temperature is greater. However, coils in such a position tend to become distorted. These tests demonstrate that heating and cooling rates can be increased if heat can be applied to the faces of the coil, i.e. the free edges of the strip constituting the coil.

GENERAL DESCRIPTION OF THIS INVENTION

An aim of one aspect of this invention is to provide a batch coil annealing facility which can anneal coiled strip more rapidly and efficiently than can be done in conventional furnaces. Accordingly, this invention provides a spacer for vertically separating coils in an annealing furnace. The spacer includes a lower segmental plate and an upper segmental plate, and ribs between the segmental plates affixed thereto. A porous medium is disposed between the segmental plates, whereby the porous medium can be heated by hot gas passing therethrough, and can radiate heat to the inside surface of the segmental plates. The porous medium is loosely enough packed to be easily permeable to hot gas, and is a wire mesh material selected from the group comprising: mild steel, stainless steel, inconel.

GENERAL DESCRIPTION OF THE DRAWINGS

One embodiment of this invention is illustrated in the accompanying drawings, in which like numerals denote like parts throughout the several views, and in which.

PARTICULAR DESCRIPTION OF THE DRAWINGS

Figure 1:
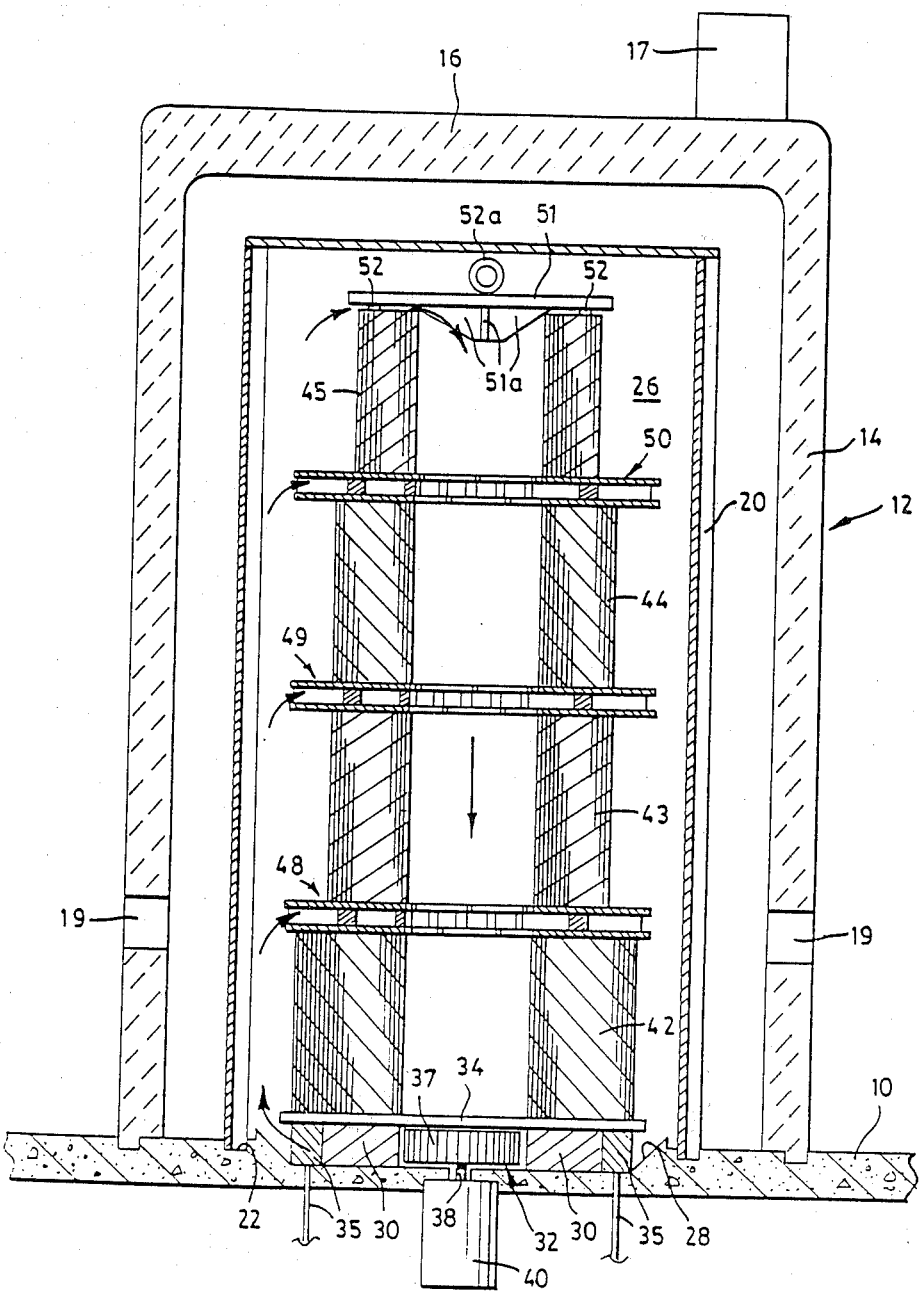
FIG. 1 is a vertical sectional view through an annealing furnace containing a plurality of coils between which spacers in accordance with this invention are provided.

Attention is first directed to FIG. 1, which shows a base flooring 10, and a furnace 12 comprising a cylindrical side wall 14 and a roof 16. A flue pipe 17 is provided, and burner ports 19 are provided in the side wall 14.

Concentrically within the cylindrical wall 14 of the furnace 12 is a, corrugated metal inner cover 20, which fits into a circular groove 22 in the base floor 10. The inner cover 20 defines an enclosed volume 26, within which an inert gas such as nitrogen can be circulated.

Within the inner cover 20, the base floor 10 has a slight recess 28 in which is located a platform consisting of radial ribs 30 circularly surrounding an open centre region 32, and a base plate 34 lying above and secured to the ribs 30. The ribs 30 thus support the base plate 34 above the concrete base floor upon which the ribs 30 rest.

A water cooling system 35 of conventional construction is provided around the periphery of the configuration defined by the ribs 30.

Within the open centre region 32 is located an impeller 37 mounted on a shaft 38 adapted to be rotated by a motor 40.

Stacked on the base plate 34 are four sheet metals coils 42, 43, 44, and 45, these being arranged in order of diminishing size or weight when the coils are of differing size or weight. Between each vertically adjacent pair of coils 42-45 is located a spacer. Thus, there are three spacers which are identified in FIG. 1 by the numerals 48, 49 and 50.

Upon the upper coil 45 is positioned a cover plate 51 which includes centering flanges **51*a* and spacers 52 which ensure a separation between the cover plate and the top of the coil 45. A lifting lug 52*a* is provided centrally on the cover plate 51**.

Figure 2:
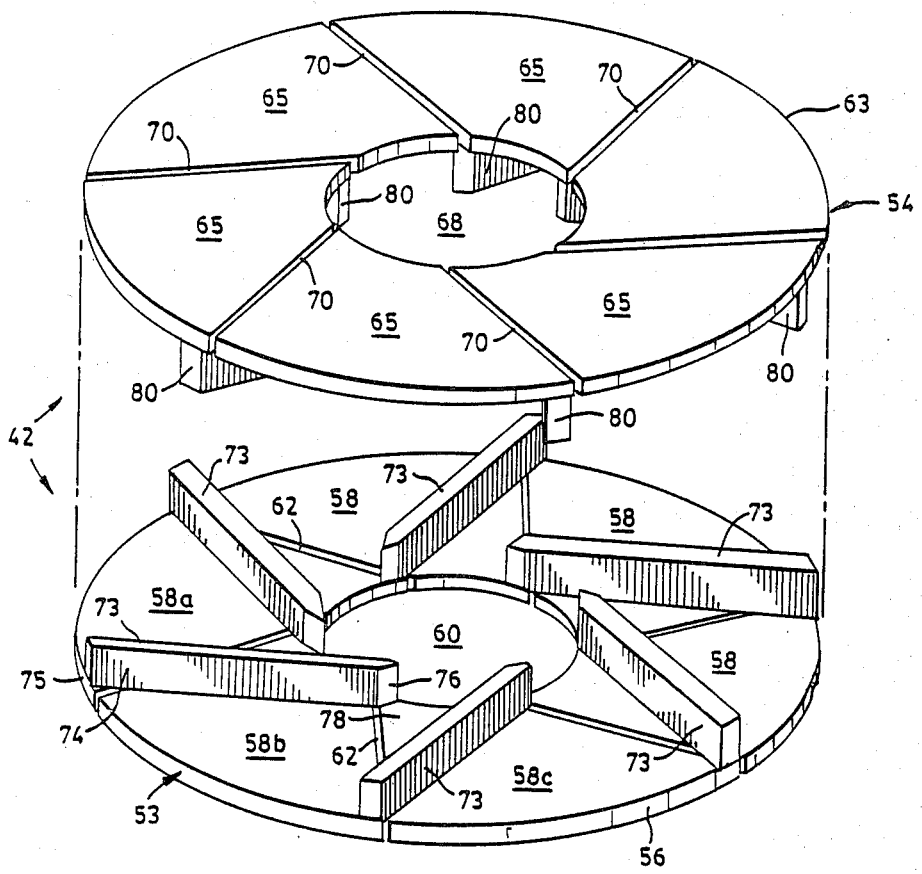
FIG. 2 is an exploded perspective view of the spacer of this invention.
Figure 3:
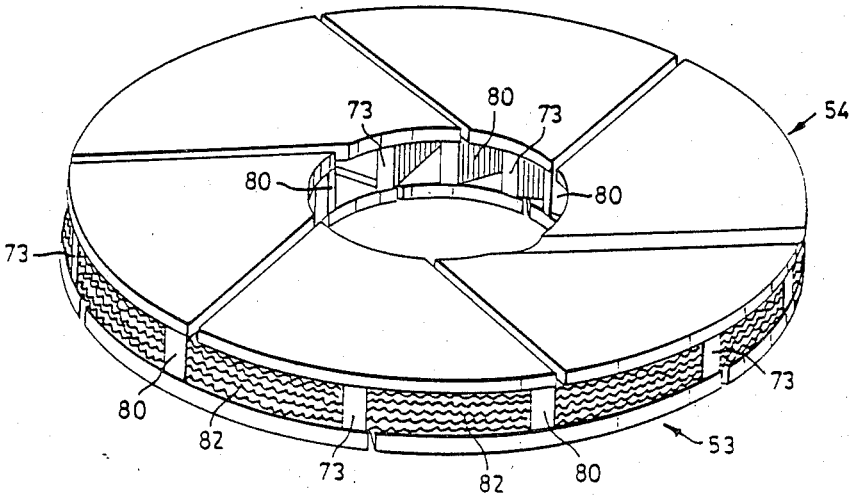
FIG. 3 is a normal perspective view of the spacer.

The construction of each spacer is more particularly seen in FIGS. 2 and 3, to which attention is now directed.

In FIG. 2, the spacer 42 is seen to include a lower composite plate 53, and an upper composite plate 54.

The lower composite plate 53 defines an outer circular periphery 56 and is composed of a plurality of lower plate segments 58 all lying in the same plane. The lower composite plate 53 has a central circular opening 60. As can be seen in the figure, there are inter-segmental gaps 62 which are located between adjacent plate segments, and which extend from the central opening 60 to the outer periphery 56. The gaps 62 are all rectilinear, but are not radially disposed with respect to the central circular opening 60. Instead, each of the gaps 62 is angled obliquely with respect to a radiant from the centre of the opening 60, and the reason for this obliquity will be explained presently.

The upper composite plate 54 has a similar construction to that of the lower composite plate 53. The upper composite plate 54 has a circular outer periphery 63 in the embodiment shown, and likewise includes a plurality of upper plate segments 65. All of the segments 65 of the upper composite plate 54 lie in the same plane, and the upper composite plate 54, like the lower composite plate 53, defines a central circular opening 68. Between each pair of plate segments 65 are provided a plurality of rectilinear gaps 70 which extend from the central opening 68 to the outer periphery 63 of the upper composite plate 54.

A plurality of rib members are disposed between the composite plates 53 and 54 when in the assembled condition of FIG. 3. In FIG. 2, the ribs include a first set of six ribs 73 which are disposed at an angle to hypothetical radial lines from the central circular opening 60. Each of the ribs 73 is rectilinear, and is disposed such that its outer end overlies an outer corner of one of the plate segments 58, and its inner end overlies an inner corner of the plate segment which is two segments further on in the direction in which the rib is sloped from its outer end to its inner end. This can be explained more clearly with reference to FIG. 2, considering the rib marked 73', which is at the near left in the lower portion of FIG. 2. The rib 73' has its outer end 74 overlapping the outer nearer corner 75 of one of the plate segments **58*a*, has its main extent traversing the plate segment 58*b* which is next in the counter-clockwise direction from the one to which the said outer corner belongs (seen from above), and has its inner end 76 overlapping the corresponding inner corner 78 of the plate segment 58*c* which is two segments further along in the counter-clockwise direction from the plate segment 58*a* of which the outer counter-clockwise corner 75 is overlapped by the outer end 74 of the rib 73'**.

As will be understood, the disposition of the ribs 73 is such that each rib is able to connect together three sequential segmental plates 58. The ribs 73 are welded or otherwise firmly affixed with respect to the segmental plates which each one overlaps.

For the upper composite plate 54, there is a second set of ribs 80, which are not fully visible in FIG. 2 because of the angle of the view. However, it will be enough to state that the ribs 80 are to all intents and purposes identical with the ribs 73, and are angled with the same degree of obliquity and in the same direction as the ribs 73. However, the ribs 80 are intended to fit equidistantly between adjacent pairs of the ribs 73 in the overall structure of the spacer when it is assembled. The ribs 73 and 80 thus alternate with each other in the completed structure, as can be seen in FIG. 3.

Returning briefly to FIG. 2, it will be clear from the figure that the ribs 80 are disposed to overlap three sequentially running plate segments 65 in exactly the same manner as has already been described in connection with the segments 58 at the lower portion of FIG. 2.

Upon completion of the assembly, the ribs 73 are of course welded or otherwise secured with respect to the upper plate segments 65, 66, whereas the ribs 80 are welded or otherwise secured to the lower plate segments 58.

In accordance with this invention, a porous medium 82 is disposed between the segmental plates 53 and 54, and between adjacent pairs of ribs 73, 80, such that the porous medium 82 can be heated by hot gas passing through it, and can then radiate heat to the inside or inner surfaces of the segmental plates 53 and 54.

In a preferred embodiment, the porous medium is a wire mesh material of either mild steel, stainless steel or inconel. It has been found that a wire of 0.011 inches diameter, knitted into corrugated sheets and laminated to provide a pad of mesh, operates quite satisfactorily within the context of this invention. The use of a pad of wire mesh using 0.011 in. diameter wire at a density of about 9 lbs per cubic foot has been quite satisfactory in terms of maximizing heat transfer between the recirculating inert gas and the coil ends during both the heat-up and cool-down portions of the annealing cycle. This wire diameter and mesh density provides about 80 $ft^2$ of wire surface and occupies only about 1.8% of the space, thus causing only nominal pressure drop.

The reason for this maximization is related to the large surface area which the wire mesh offers to the inert gas as the latter passes between the coils, i.e. between the segmental plates 53 and 54 of each spacer 48, 49 and 50.

For example, on heat-up, the inert gas contacts the wire mesh and loses heat to it. The mesh then radiates the heat to the inside surfaces of the composite plates 53 and 54, which in turn lose the heat to the coil ends. The opposite effect occurs during cool-down.

In general terms, the porous medium could be any porous medium, such as sintered metal powder, metal fibers, or ceramic refractory fibers, that is chemically compatible with the gas utilized inside the inner cover, and which is able to withstand gas temperatures of about 1500° to 1800° F. It is to be understood that heat transfer with respect to the mesh does not depend on the mesh material. The physical presence of the mesh in the gas stream increases the surface area presented to the gas for convective heat transfer in the spacer, and it has been found that the presence of the mesh increases the heat transfer rate from the gas to the spacer by a factor of about 7.

The reason for the sectioning of the upper and lower segmental plates relates to the necessity to allow for uniform radial thermal expansion and contraction during heating and cooling. Of course, the particular shape and direction of the expansion joints are arbitrary, generally being selected for design convenience.

It is considered that the total amount of mesh material present in the spacer should meet certain specific criteria.

(a) The spacer itself must be as thin as possible because of space limitations in the annealing furnace, thereby limiting the total volume which the mesh material can occupy.

(b) From a heat transfer standpoint, the density of the porous medium must be great enough to present adequate surface area to the gas, but low enough so that hot wires in the mesh can radiate directly to the inner surfaces of the segmental plates 53 and 54. As previously stated, a density of about 9 lbs per cubic foot has been shown to operate satisfactorily. However, it is considered that media in the density range from about 5 $lb/ft^3$ to about 100 $lb/ft^3$ would perform satisfactorily. Also, more than one type of porous medium could be used together in the performance of this invention.

(c) The porous medium itself must be porous enough that resistance to gas flow is minimized.

We claim:

1. A spacer for vertically separating coils in an annealing furnace, the spacer comprising a lower segmental plate and an upper segmental plate, ribs between the segmental plates and affixed thereto and a porous medium disposed between the segmental plates, whereby the porous medium can be heated by hot gas passing therethrough and can radiate heat to the inside surfaces of the segmental plates, the porous medium being loosely enough packed to be easily permeable to such hot gas, the porous medium being a wire mesh material selected from the group comprising: mild steel, stainless steel, inconel.

2. A spacer for vertically separating coils in an annealing furnace, comprising:

a lower composite plate and an upper composite plate, the lower composite plate having an outer periphery and including a plurality of lower plate segments all lying in a first plane, the lower composite plate defining a central opening and having gaps between adjacent plate segments which extend from said central opening to said outer periphery, the upper composite plate having an outer periphery and including a plurality of upper plate segments all lying in a second plane, the upper composite plate defining a central opening and having gaps between adjacent plate segments which extend from said central opening to the outer periphery of the upper composite plate, a plurality of rib members between the composite plates and disposed to cross the said gaps, the rib members being affixed to the plate segments so as to rigidify the overall spacer, and a porous medium disposed between the two composite plates and between adjacent pairs of ribs, the porous medium being loosely enough packed to be easily permeable to hot gas passing therethrough, the porous medium being a wire mesh material selected from the group comprising: mild steel, stainless steel, inconel.

3. A spacer as claimed in claim 2, in which each composite plate has a circular periphery and a circular central opening concentric with the circular periphery, at least one of (a) the gaps, (b) the rib members, extending along lines forming angles with radial lines from the center of the central opening.

4. A spacer as claimed in claim 3, in which both the gaps and the rib members extend obliquely to lines which are radial with respect to the central opening.

5. A spacer as claimed in claim 1, claim 2 or claim 3, in which the wire of the wire mesh material is knitted into corrugated sheets and laminated to provide a pad of mesh with a density between about 5 and about 100 pounds per cubic foot.

6. A spacer as claimed in claim 1, claim 2 or claim 3, in which the wire is about 0.011 inches in diameter, and is knitted into corrugated sheets and laminated to provide a pad of mesh with a density of about 9 lbs per cubic foot.

* * * * *